US005248989A

United States Patent [19]

Murdoch

[11] Patent Number: 5,248,989

[45] Date of Patent: Sep. 28, 1993

[54] MAGNETIC FIELD CONCENTRATOR

[75] Inventor: Graham A. M. Murdoch, Perth, Australia

[73] Assignees: Unisan Ltd.; Magellan Technology Pty. Ltd., Australia

[21] Appl. No.: 928,545

[22] Filed: Aug. 13, 1992

Related U.S. Application Data

[63] Continuation of Ser. No. 459,767, Jan. 10, 1990, abandoned.

[30] Foreign Application Priority Data

Feb. 4, 1988 [AU] Australia ..... PI 6581

[51] Int. Cl.[5] ..... H01Q 7/00; H01Q 7/02; H01Q 7/04

[52] U.S. Cl. ..... 343/841; 343/842

[58] Field of Search ..... 343/841, 842, 866, 867, 343/741, 742

[56] References Cited

U.S. PATENT DOCUMENTS

| | | | |
|---|---|---|---|
| 1,683,773 | 9/1928 | Goldsmith | 343/867 |
| 2,202,368 | 5/1940 | Berndt | 343/866 |
| 2,607,894 | 8/1952 | Johnson | 343/784 |
| 3,872,455 | 3/1975 | Fuller et al. | 343/842 |
| 3,902,177 | 8/1975 | Mori et al. | 343/842 |
| 4,373,163 | 2/1983 | Vandebult | 343/842 |
| 4,549,186 | 10/1985 | Gross et al. | 343/748 |
| 4,605,899 | 8/1986 | Eumurian et al. | 343/842 |
| 4,628,324 | 12/1986 | Gross et al. | 343/788 |
| 4,717,921 | 1/1988 | Ohe et al. | 343/841 |
| 4,754,284 | 6/1988 | Ohe et al. | 343/842 |
| 5,039,996 | 8/1991 | Fockens | 343/866 |

*Primary Examiner*—Rolf Hille
*Assistant Examiner*—Hoanganh Le
*Attorney, Agent, or Firm*—Learman & McCulloch

[57] ABSTRACT

A concentrator adapted to concentrate signals for reception by a receiver, said concentrator comprising a conductive portion juxtaposed with said receiver, said concentrator being aligned so as to receive said signals and cause further signals to impinge on said receiver and thereby enhance reception of said signals by said receiver. Also disclosed is a shield for substantially eliminating magnetic field radiation from within a predetermined area, the field being diverted from the area via a conductive strip.

6 Claims, 8 Drawing Sheets

MAGNETIC FIELD CONCENTRATOR

This application is a continuation of application Ser. No. 07/459,767, filed Jan. 10, 1990, now abandoned.

BACKGROUND OF THE INVENTION

1. Field of the Invention

The present invention relates to magnetic field concentration apparatus, particularly signal enhancement and/or apparatus for confining magnetic flux within an aperture, and/or to shield magnetic flux from components, and/or to means for improving signal reception. The present invention has a particular application to passive devices, such as tokens, transponders or smart cards.

2. Prior Art

It is well known that metal placed in the proximity of a magnetic field receiving coil will substantially reduce the amount of magnetic field received by the coil. For example, metal placed between a source of the magnetic field and the coil can operate to prevent any magnetic field from being picked up by the coil as shown in FIG. 1. The metal sheet serves to absorb and deflect the flux radiated from the driver coil or magnetic field source.

FIG. 2 shows another situation where a metal sheet serves to reduce signal reception. The metal sheet is placed behind the coil. The metal sheet acts to reduce the amount of flux received by the coil by radiating an opposing flux field. The closer the metal sheet, to the coil, the larger the opposing flux field and the less signal flux is received by the coil. In effect the metal sheets serve to proportionately nullify the driver coil radiated flux.

U.S. Pat. No. 4,373,163 discloses an electrostatic shield with an antenna loop therein (FIG. 1). The antenna is surrounded by a metal shield. The specification does not disclose a conductor plate proximate and in substantially the same plane as an antenna to enhance signal reception, in accordance with the present invention as will be described in more detail hereinafter.

U.S. Pat. No. 4,486,731 discloses a signal enhancement apparatus in the form of a coil having magnetically permeable material disposed in overlapping relationship with a coil. The coil is influenced by strips 23 and 24 when the coil is oriented parallel to the direction of impinging flux (column 2, lines 23 to 41). However, U.S. Pat. No. 4,486,731 relates to the problem of coil reception the coil is in the same plane as the impinging flux, whereas the present invention relates to increasing the reception of flux by a coil by providing a concentrator in juxtaposition to and in substantially the same plane, as the coil.

U.S. Pat. No. 4,754,284 discloses an automobile antenna system for use in receiving high frequency bands in excess of 50 MHz.

SUMMARY OF THE INVENTION

An object of the present invention is to provide a concentrator which can be associated or juxtaposed a coil without deleterious effect on the coil's ability to receive is signals or magnetic fields.

Another object of the present invention is to provide improved concentrator performance.

Another object of the present invention is to provide a shield from magnetic radiation and to provide a radiation concentrating apparatus which are substantially more compact than prior art arrangements.

The present invention provides:

A shield for alleviating radiation from magnetic fields within a predetermined area, the shield comprising an inner loop member and outer loop member, the inner loop member having first and second parts, and being continuous between said first and second parts, the first part being opposingly juxtaposed and spaced from said second part, the inner loop member encircling said predetermined area, the outer loop member having third and fourth parts, aligned with the first and second parts respectively, the outer loop member being continuous between said third and fourth parts, the third part being opposingly juxtaposed and spaced from said fourth part, the outer loop member encircling the inner loop member, and a first interconnecting part coupling said first and fourth parts and a second interconnecting part coupling said second and third parts.

The present invention also provides:

An improvement in magnetic field concentrating apparatus for enhancing reception of a signal, said apparatus comprising a concentrator, a coil and a capacitor, the capacitor and coil forming a resonant circuit, a portion of said coil being disposed in a plane juxtaposed said concentrator, said concentrator comprising an electrically conductive portion for causing flux resultant from said signal to impinge on said portion of said coil, said electrically conductive portion comprising a portion of a plate of said capacitor.

The loops and interconnecting portions mentioned above and the conductive portion mentioned above are preferably made of metal, for example, aluminum or copper.

The present invention provides a significant advantage over prior art arrangements. In known prior art arrangements, a resonant circuit would be provided by a capacitor (say of area 1 unit) and an inductor (say also of area 1 unit). In the prior art, signal reception can only occur on the inductor of 1 unit. In the present invention, the electrically conductive portion of the concentrator shield comprises a portion of a plate of a capacitor. In this way one of the plates or the capacitor may also receive a signal, the signal receiving area is, therefore, two units, that is the area of the capacitor and the area of the inductor. Thus, the coil and capacitor may be reduced (by up to fifty percent) so that 1 unit of signal is still received in the present invention (rather than 2 units) to equate to the signal reception of the prior art. The capacitor and inductor areas may, however, be maintained thereby allowing the present invention to provide signal reception of greater strength than is known in the prior art arrangements.

BRIEF DESCRIPTION OF THE DRAWINGS

Preferred embodiment(s) of the present invention will now be described with reference to the accompanying drawings, wherein:

FIGS. 1 and 2 show prior art arrangements.

FIGS. 3 to 14A–14C show various exemplary (only) forms of concentrator according to the present invention.

DESCRIPTION OF THE PREFERRED EMBODIMENTS

Throughout this document, the term "coil" should be construed in a non-limiting way. The term "coil" may include, for example, any signal receiving apparatus or magnetic field receptor as the present invention has many applications. As can be appreciated, the shape of the metal herein described should not be limited to a particular configuration. The shape of metal is dependent on its application or use.

Also, throughout this document, the terms "signal" or "signals" include within their scope any form of electromagnetic radiation. The signal may, for example, be a powering signal or a data or informational signal.

Figure 1:
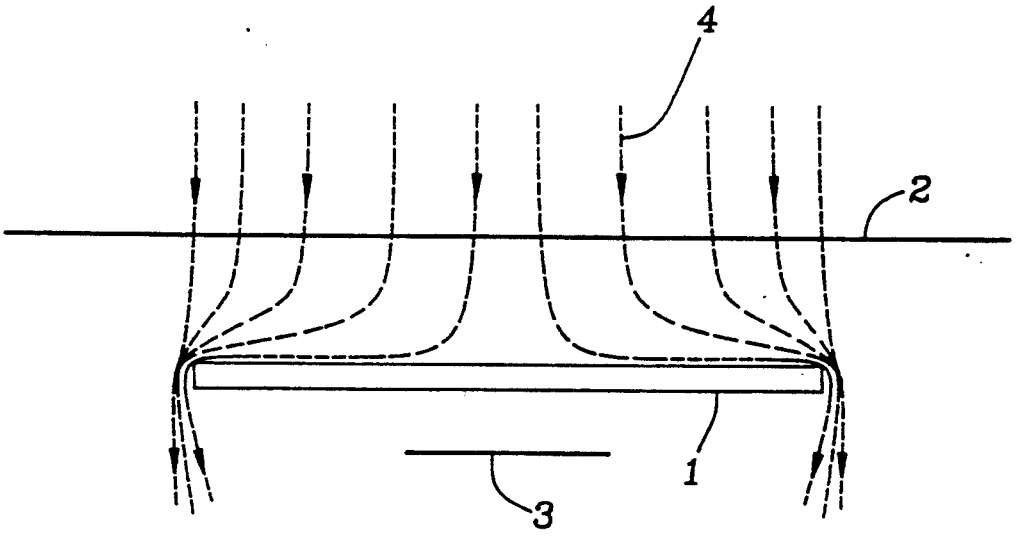
FIGURE 1 (PRIOR ART)
FIGS. 1 and 2 are diagrammatic views showing prior art arrangements.
Figure 2:
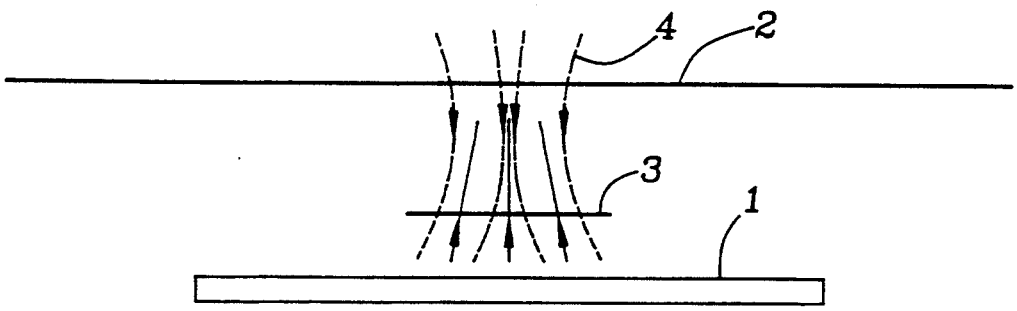
FIGURE 2 (PRIOR ART)

FIG. 1 shows a prior art arrangement wherein a metal sheet 1 is interposed between a flux source 2 and a coil 3. FIG. 2 shows another prior art arrangement wherein the coil 3 is interposed between the metal sheet 1 and the flux source 2. Flux and its direction are indicated by the lines 4.

Although metal placed proximate a receiving coil is known to reduce the coil's receptive ability, a metal sheet placed in juxtaposition and/or in substantially the same plane as the coil as will be hereinafter detailed will not have a negative effect on the coil's receptive ability.

Figure 3:
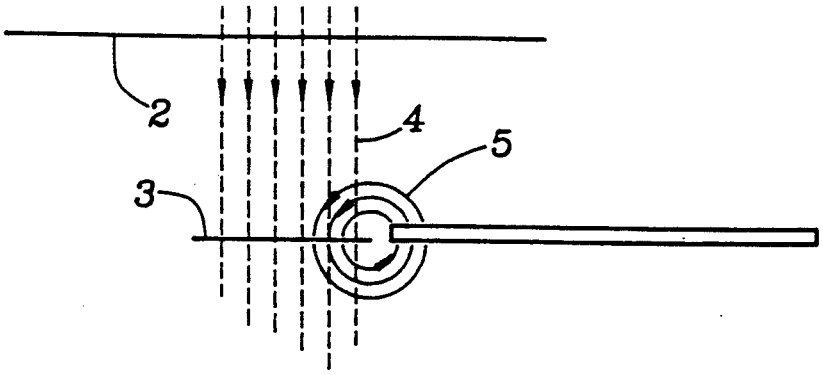
FIGS. 3 to 14A–14C show diagrammatically various exemplary forms of the concentrator according to the present invention.

FIG. 3 shows the metal sheet 1 placed in the same plane as the coil. The metal serves to increase the amount of flux, impinging the coil. The increased of flux 5 on the coil due to the metal is inversely proportional to the spacing between the metal and the coil.

Figure 4:
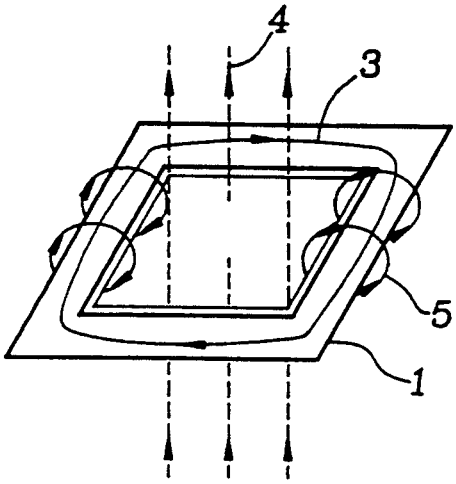

FIG. 4 shows a coil 3 surrounded in the coil's plane by metal. As can be seen, the additional fluxes produced by circulating currents, oppose and reduce the applied currents. Accordingly, no flux enhancement is produced for the coil the metal surrounds.

Figure 5:
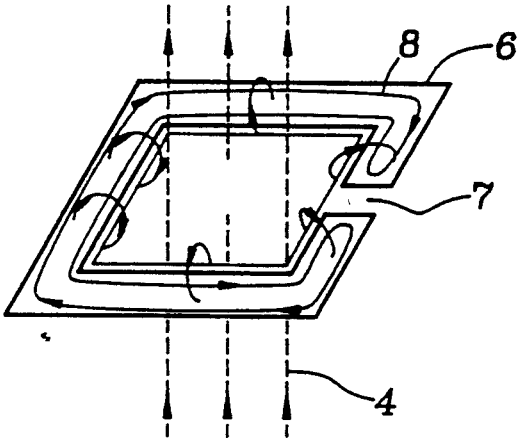

FIG. 5 shows a metal plate 6 similar in shape to that previously mentioned, however, a slot or gap 7 is provided in the metal so that the metal surrounds the coil 8 in a discontinuous manner.

The gap in the metal surrounding the coil causes the eddy currents (produced in response to impinging flux) to produce a field that serves to increase the flux impinging the coil.

Figure 6:
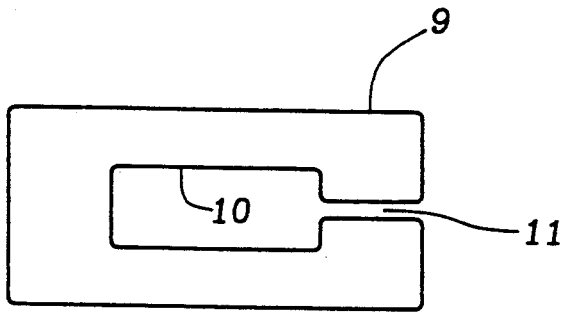
Figure 6A:
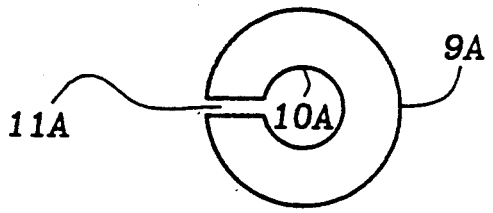
Figure 7:
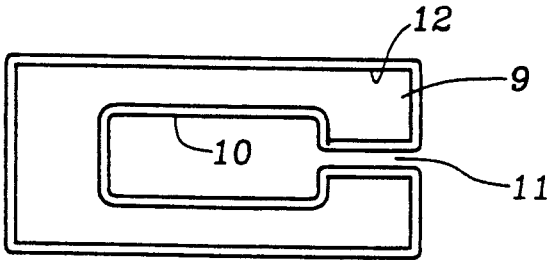
Figure 7A:
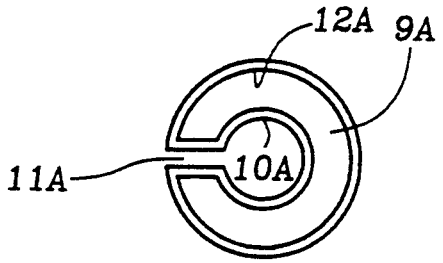

FIGS. 6A, and 7, 7A show concentrators similar to that hereinbefore described.

The concentrator may be preferably constructed in two forms:

(i) A metal plate 9, 9A with a hole 10, 10A cut to allow the magnetic flux to pass through. A slot or slots 11, 11A are cut from the hole out to the perimeter to alleviate circulating currents, which causes a drastic reduction in flux, from encircling the hole. The slot(s) may overlap, as long as there is substantially no continuous conduction path around the central hole (as shown in FIGS. 5, 6 and 7). Copending Applications PI 7198 ANTENNA STRUCTURE AND METHOD OF MANUFACTURE and PJ 1693 INDUCTIVE ELEMENT FOR USE AS AN ANTENNA IN TRANSPONDERS filed in the name of Magellan Corporation (Australia) Pty. Limited disclose a method of simultaneously fabricating electrical coils and capacitors, and now forming PCT specification No. PCT/AU90/00095. Transponders, identification devices or the like employ resonant circuits which comprise interconnected inductors or coils and capacitors, and optionally include interconnected active circuitries embodied in VLSI integrated circuit chips. The resonant circuits are adapted to receive electrical power from an external electromagnetic field generated by some interrogators or like apparatus. Optionally, the resonant circuits supply the power so received and collected to the active circuitries which may then generate the appropriate electrical signals as predetermined. Such signals may further be sent to other inductors, preferably the same power receiving inductors, functioning as antennae for transmission of the signals, to be received by some external receptors preferably the same interrogators.

Accordingly, it is of significance that in the construction and fabrication of the complete electronic circuits of the transponders, identification devices or the like, the capacitors and inductors or coils should be conveniently interconnected.

The circuit for use in a transponder, identification device or the like, can comprise at least one inductive element or coil wherein said at least one generally elongate or serpentive conductive strip is arranged on the one and same insulative substrate. The electronic circuit may further comprise at least one capacitive element, each capacitive element comprising a plurality of conductive members arranged on one or both sides of the one and same insulative substrate such that said plurality of conductive members superpose each other by the folding of the substrate to form at least one capacitor. Conveniently, the plates of capacitors so fabricated may take a substantially "C" shaped configuration and be disposed to surround the associated coils as hereinbefore described. This technique permits the area consumed by said capacitor plates to contribute towards the flux gathering ability of said coils.

(ii) A wire loop concentrator 12, 12A using high conductivity wire, for example bent to follow the perimeter of the metal plate shown in FIGS. 7, 7A, 9 and 10, may perform the same concentrating function provided the wire forms a continuous conducting path.

Figure 8:
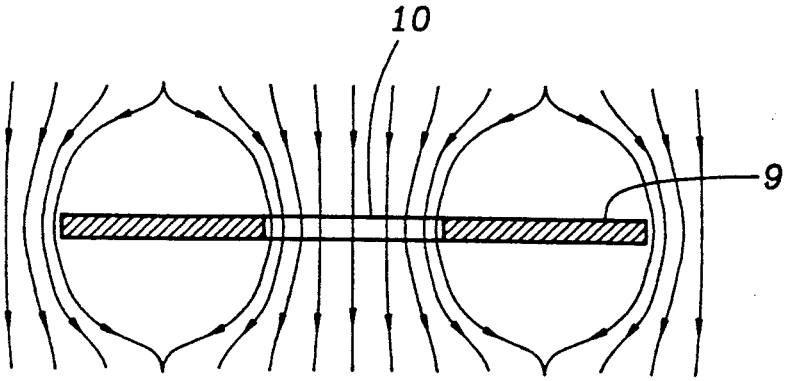

The operation of both exemplary forms as shown in the drawings can be described thus:

(i) Circulating currents induced on the surface of a metal plate prevent an alternating magnetic flux from penetrating below the skin depth. For 100 KHz on copper, this is about 0.18 mm. Consequently, an alternating flux cannot penetrate thick metal plates and flows around the conducting obstacle. With a hole cut in the metal plate, some of the flux interrupted by the plate is diverted through the hole increasing the flux density in that area, while the balance goes around the outer edge of the plate 9 (FIG. 8). Without the slot, the metal plate acts as a one turn short circuit. This may maintain an almost equal in magnitude, oppositely directed flux in the central hole cancelling most of the flux trying to pass through it. This may have a negative effect for magnetic field concentration purposes, but may be used to substantially exclude flux from an area.

Figure 9:
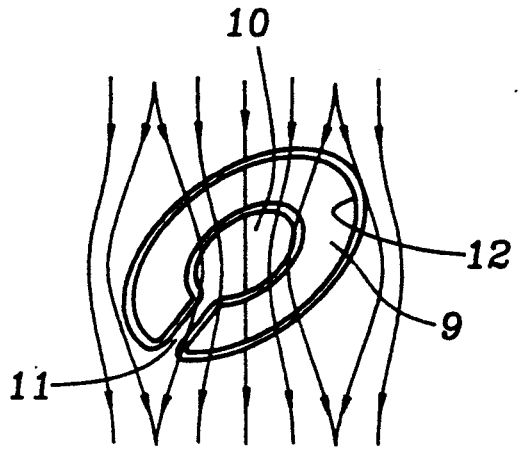

(ii) The wire loop acts as a one turn short circuit. The back emf generated in the wire loop ensures that the total flux passing through the space between the inner and outer loops is very small, only enough to account for ohmic losses. The flux intercepted by the loop configuration is concentrated in the inner loop in substantially the same manner as for the metal plate (FIG. 9).

Figure 10:
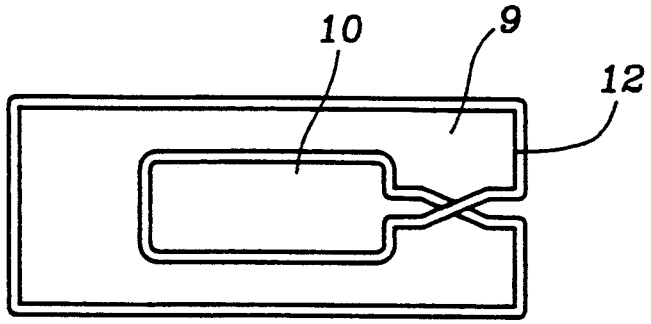

The wire loop concentrator may also be used to substantially exclude flux from an area. By crossing the wire connections between the inner and outer loops, without allowing them to touch, the flux passing through the inner loop is drastically reduced. FIG. 10 shows an example of this configuration.

Figure 11:
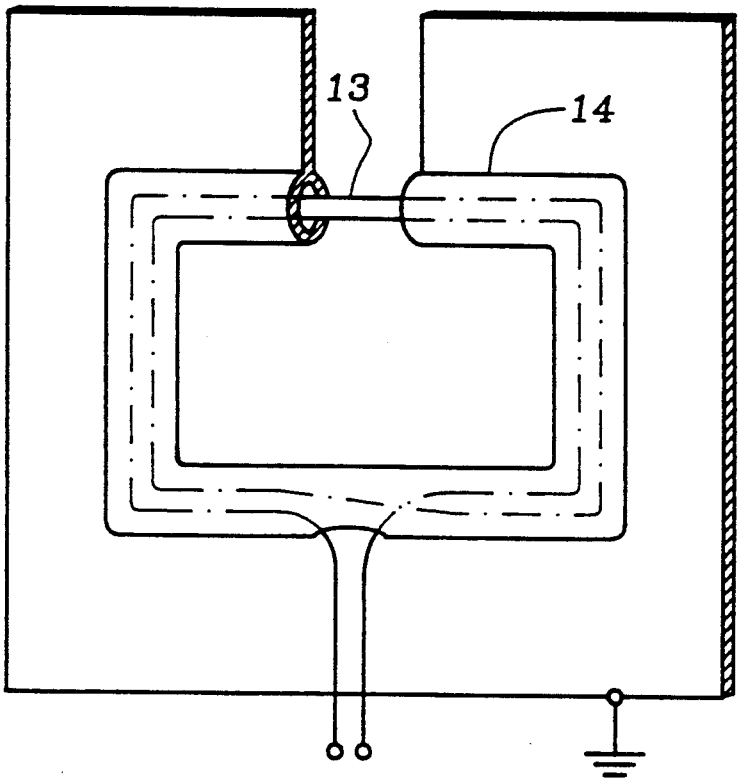

FIG. 11 shows an example of a field concentrator acting as an electrostatic Faraday shield. The coil 13 is shown partially surrounded by a conventional Faraday shield 14. The Faraday shield is extended to form a field concentrator, or may be coupled to an existing concentrator.

Electrostatic shielding reduces the capacitive sensitivity of the coil to objects in the vicinity of the coil. The Faraday shield may extend only part way around the coil in order to adjust capacitive sensitivity.

Figure 12:
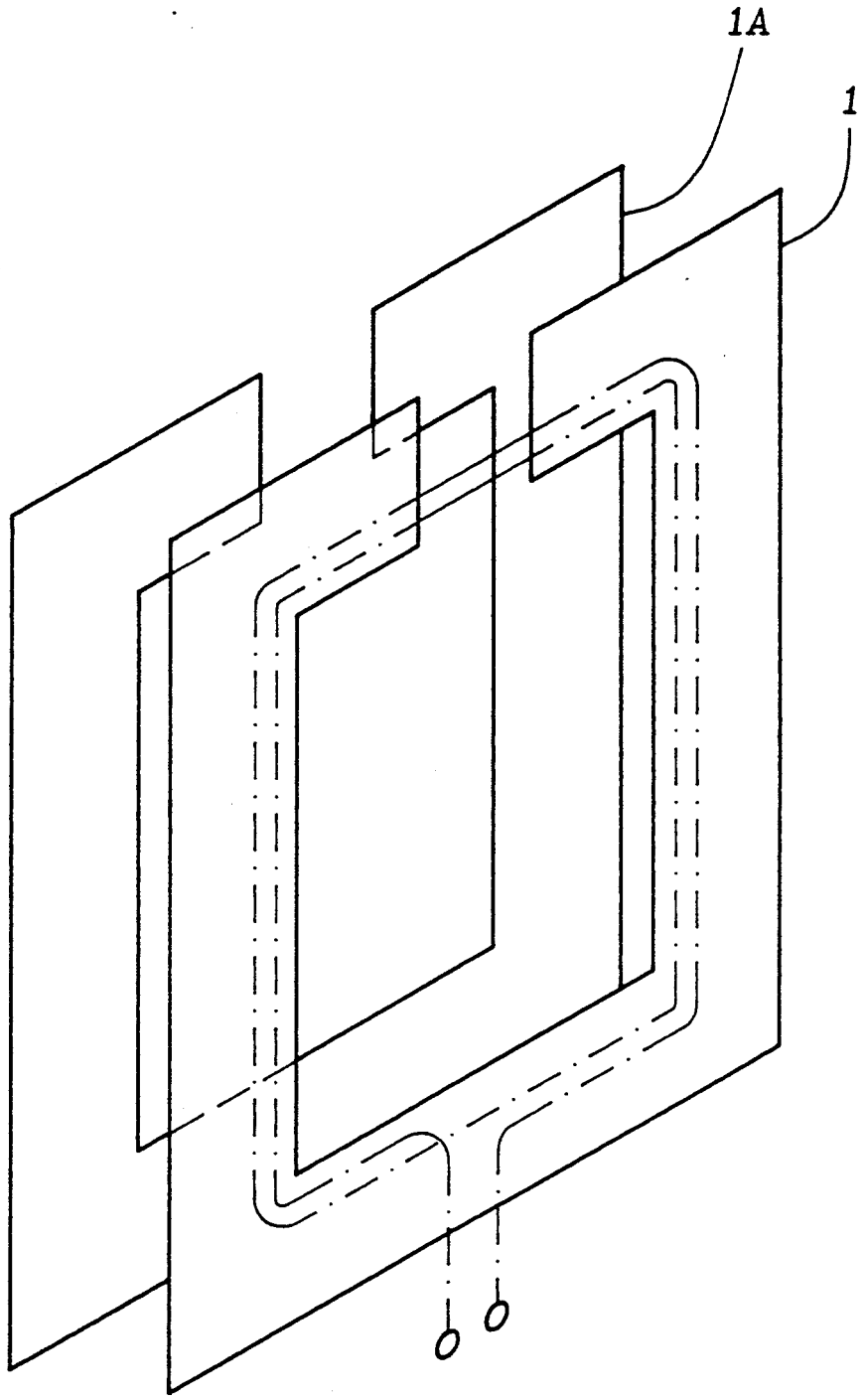

Alternatively, field concentration and electrostatic shielding can be achieved using two field concentration plates 1, 1A. One plate may be placed in front of the coil, and the other behind the coil as shown in FIG. 12.

Figure 13:
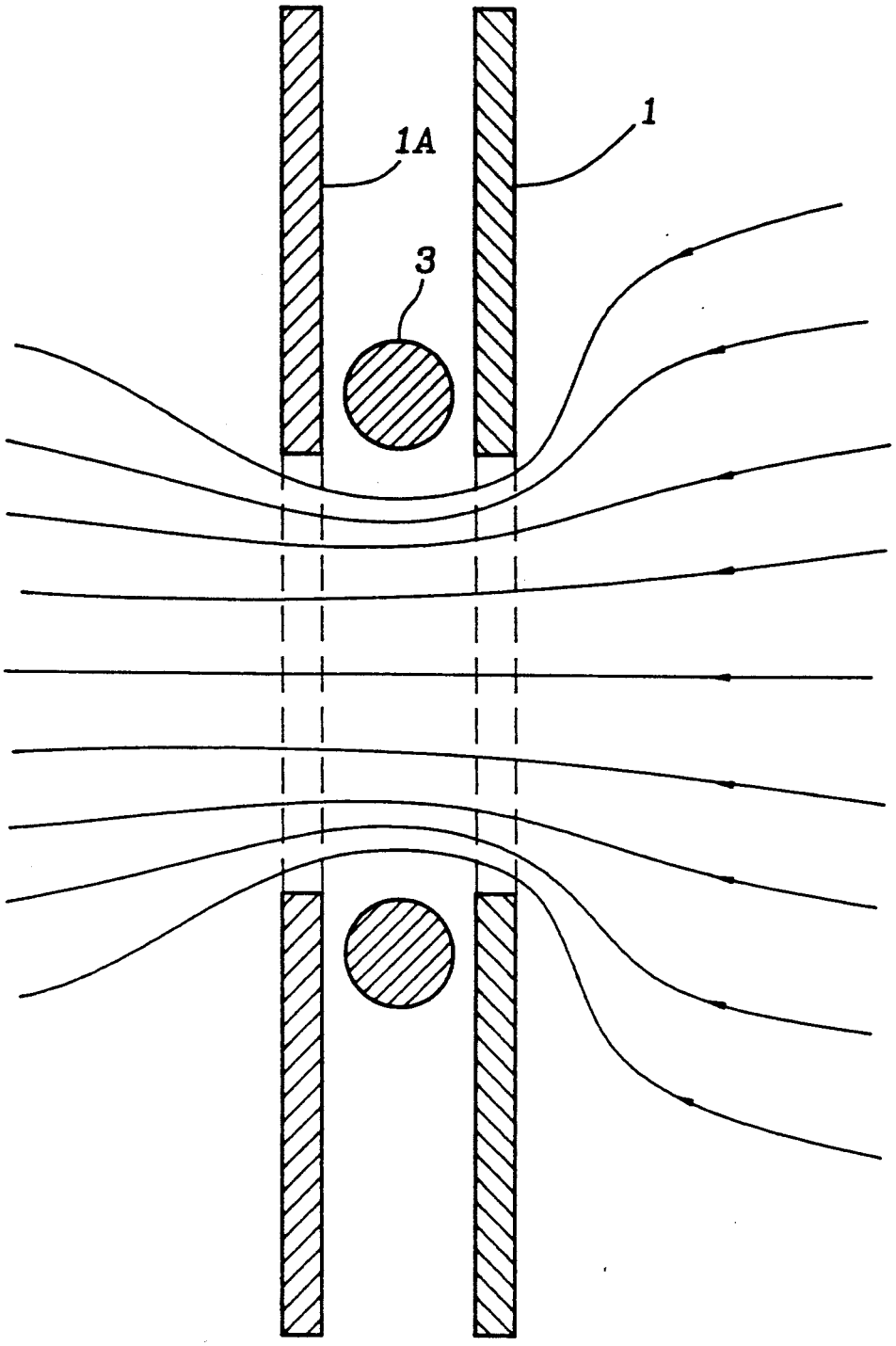
Figure 14A:
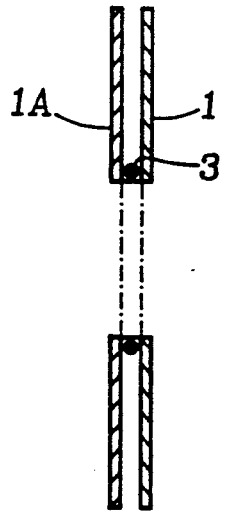
Figure 14B:
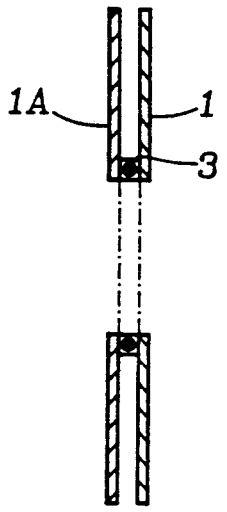
Figure 14C:
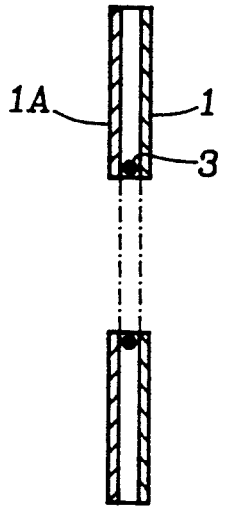

FIG. 13 shows a cross-section of this arrangement. Connection between the front and back plates can be made anywhere along the plates, howevers preferably this is done on the inside and/or the outside of the coil. See FIGS. 14A, B and C, wherein FIG. 14A shows innermost connections between the plates 1, 1A; FIG. 14B shows connections at either side of the coil; and FIG. 14C shows connections at the inner and outer perimeters of the plates.

I claim:

1. A shield for alleviating radiation from magnetic fields within a predetermined area, the shield comprising an inner loop member and outer loop member, the inner loop member having first and second parts, and being continuous between said first and second parts, the first part, being opposingly juxtaposed and spaced from said second part, the inner loop member encircling said predetermined area, the outer loop member having third and fourth parts, aligned with the first and second parts respectively, the outer loop member being continuous between said third and fourth parts, the third part being opposingly juxtaposed and spaced from said fourth part, the outer loop member encircling the inner loop member, and a first interconnecting part coupling said first and fourth parts and a second interconnecting part coupling said second and third parts.

2. A shield as claimed in claim 1 wherein all of said parts are constructed of metal.

3. An improvement in magnetic field concentrating apparatus for enhancing reception of a signal, said apparatus comprising a concentrator, a coil and a capacitor, the capacitor and coil forming a resonant circuit, a portion of said coil being disposed in a plane juxtaposed said concentrator, said concentrator comprising an electrically conductive portion for causing flux resultant from said signal to impinge on said portion of said coil, said electrically conductive portion comprising a portion of a plate of said capacitor.

4. An improvement as claimed in claim 3, wherein said conductive portion substantially surrounds said portion of said coil in a discontinuous manner.

5. An improvement as claimed in claim 3, wherein said conductive portion is substantially "C" shaped.

6. An improvement in magnetic field concentrating apparatus as claimed in claim 3 wherein said conductive portion is constructed of metal.

* * * * *